United States Patent [19]

Kerstens

[11] 4,039,892

[45] Aug. 2, 1977

[54] RESONANT CAVITY MAGNETRON HAVING A MAGNET SYSTEM AND MAGNETRON DESTINED FOR SUCH A COMBINATION

[75] Inventor: Franciscus Napoleon Adrianus Kerstens, Eindhoven, Netherlands

[73] Assignee: U.S. Philips Corporation, New York, N.Y.

[21] Appl. No.: 648,310

[22] Filed: Jan. 12, 1976

[30] Foreign Application Priority Data

Mar. 13, 1975 Netherlands ..... 7502972

[51] Int. Cl.[2] ..... H01J 25/50

[52] U.S. Cl. ..... 315/39.71; 315/39.51

[58] Field of Search ..... 315/39.71, 39.51

[56] References Cited

U.S. PATENT DOCUMENTS

| | | | |
|---|---|---|---|
| 3,169,211 | 2/1965 | Drexler et al. | 315/39.51 X |
| 3,558,970 | 1/1971 | Van De Goor et al. | 315/39.71 |
| 3,562,579 | 2/1971 | Kakizawa et al. | 315/39.51 |
| 3,746,916 | 7/1973 | Oguro | 315/39.71 |
| 3,781,592 | 12/1973 | Harrold | 315/39.71 |
| 3,809,950 | 5/1974 | Koinuma | 315/39.71 |
| 3,846,667 | 11/1974 | Hisada et al. | 315/39.71 |
| 3,916,247 | 10/1975 | Koinuma et al. | 315/39.51 |

*Primary Examiner*—Saxfield Chatmon, Jr.
*Attorney, Agent, or Firm*—Frank R. Trifari

[57] ABSTRACT

In a magnetron for heating purposes the poleshoes are present entirely within the vacuum space but they have each been formed from one piece of material with the axially directed pole plates by punching and deep-drawing, preferably in the form of a cylindrical sleeve having a profiled bottom.

2 Claims, 4 Drawing Figures

RESONANT CAVITY MAGNETRON HAVING A MAGNET SYSTEM AND MAGNETRON DESTINED FOR SUCH A COMBINATION

The invention relates to a resonant cavity magnetron having built-in poleshoes in which radially magnetized permanent magnets adjoin axially directed pole plates, said magnets being connected by one or more soft magnetic yokes. The invention furthermore relates to a magnetron destined for such a combination.

The usual sintered permanent magnetic materials are best suited for the relevant magnet systems in connection with their price and magnetic properties.

In order to prevent misunderstanding in connection with terms used in various publications, poleshoes are to be understood to mean in this connection those soft magnetic parts between the operational field and pole plates.

In the constructions known from the German Auslegeschrift No. 1,114,595 the pole plates consist of sleeves which are open at one end and have square or circular cross-sections. Adjoining said sleeves are the sintered permanent magnets in the form of axially magnetized flat ring stacks in the case of the square sleeves, respectively in the form of radially magnetized rings in the case of the circular sleeves. The bottom of the sleeves is partly open and profiled in such manner that connection is obtained to the end plates of the magnetron housing which also constitute the poleshoes. In the square sleeves there are four connection yokes between the outer poles of the permanent magnets and in the circular sleeves with ring magnets a circular cylindrical sleeve constitutes the magnetic yoke. In one of the four yokes, respectively in said sleeve, an aperture for the radial coupling-out and an aperture for the water cooling ducts are present.

The stray field of such a construction is rather small because the parts which mutually have a high magnetic potential show a large distance in relation to their extent.

A drawback of the known construction, however, is that the requirements imposed upon the matching to each other of the profiles of the pole sleeves and the end plates so as to obtain a low reluctance are rather high so that the price is unfavorably influenced. The use of axial coupling-out and the supply of the filament is also difficult in this case. For magnetrons destined for heating purposes, for example the preparation of food, a low price and a simple build-in possibility is an important requirement; this is obtained in general by an axial construction.

According to the invention, in a resonant cavity magnetron having built-in poleshoes in which radially magnetized permanent magnets adjoin axially directed pole plates, which magnets are connected by one or more magnetic yokes, each poleshoe and the associated pole plates consist of a single piece of material, the actual poleshoe being present entirely within the vacuum space, the filament connection and the cathode connection and the coupling-out lead respectively being incorporated in the parts of the vacuum space within the pole plates. Due to the fact that pole plates and poleshoe consist of one piece of material, the reluctance is as small as possible and the magnetic field also has a good rotational symmetry. The space within the pole plates may as a result also be larger so that the axial cathode supply and coupling-out lead can be realised in a simple manner.

The poleshoe and the pole plate are preferably made from a sheet material which, as regards the poleshoe part is given the correct shape by pressing and punching, while the pole plates in the case of a circular-cylindrical construction may be formed by deep-drawing at the poleshoe. In the case of a square or another polygonal construction the pole plates are formed by folding parts cut from the sheet material of the poleshoes.

Due to the chosen construction which has a low magnetic resistance and can be formed by punching and deep-drawing and folding, respectively, the price is comparatively low. Moreover, only little permanent magnetic material is necessary.

Because, according to the invention, the anode housing can also be manufactured by pressing and drawing and hence no turning operation is involved, the magnetron is entirely constructed from such components and is hence particularly favorable in price.

In the case in which the magnetron has air cooling fins at right angles to its longitudinal axis, the magnetic yoke consists of an elongate box two long sides of which are open and the other two long sides of which adjoin the outsides of the magnets with flanges.

In the case of a circular-cylindrical construction for lower powers, according to the invention, sufficient cooling can be obtained by connecting the magnets to a circular-cylindrical sleeve and enclosing a metal ring between this and the housing of the magnetron so as to conduct heat to the exterior.

The invention will be described in greater detail with reference to the drawing in which.

Figure 4:
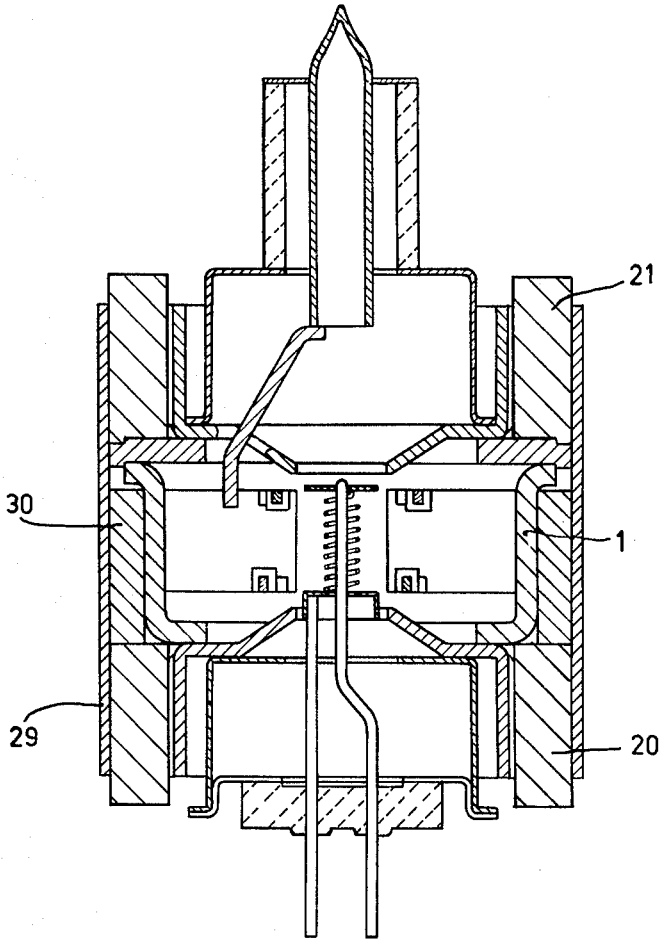

and FIG. 4 is a sectional view of a magnetron having a clamped cooling ring.

Figure 1:
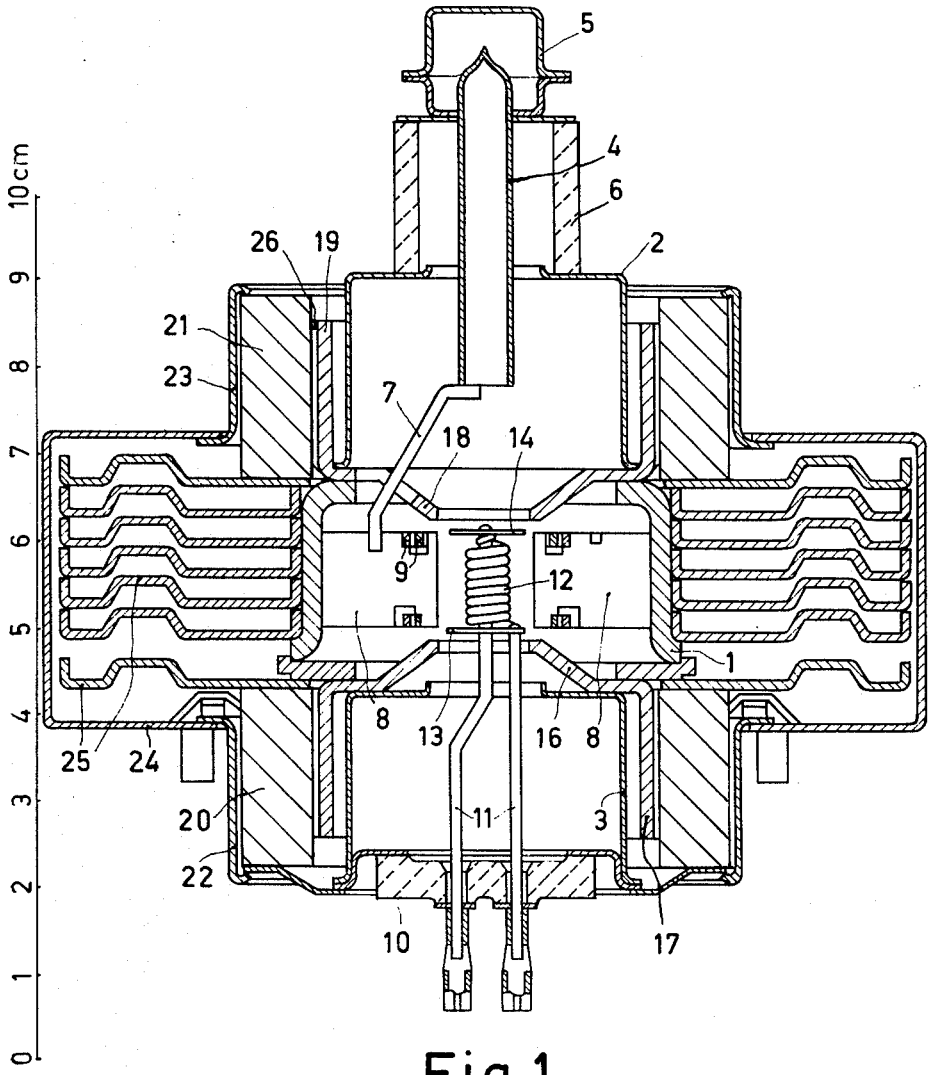
FIG. 1 is an axial sectional view through a magnetron according to the invention having air cooling.

Reference numeral 1 in FIG. 1 denotes the drawn copper magnetron-anode housing with flat cover. The vacuum space is further surrounded by nickel-plated sleeves 2 and 3 of an iron-nickel-cobalt alloy. The coaxial coupling-out system consists of an exhaust tube 4 terminating in a sealing cap 5 which is inserted in a wave guide or resonant cavity against which the sleeve 2 adjoins. 6 denotes the ceramic insulator between inner and outer conductor of said coupling-out system. A flat copper strip 7 connects the inner conductor 4 to one of the anode vanes 8 which are soldered in the anode housing 1. The anode vanes 8 are connected at each end by rings 9. A ceramic plate 10 which is connected to the bottom of the sleeve 3 by soldering serves as a supporting plate for both cathode filament supplies 11. The cathode 12 consists of a helical thorium-tungsten wire enclosed between two molybdenum plates 13 and 14. The poleshoe 16 forming one assembly with the pole plate sleeve 17 is soldered between the anode housing 1 and the sleeve 3. The same is the case with the poleshoe 18 and the pole plate sleeve 19 between the anode housing 1 and the sleeve 2. The material for said parts is mild steel. Magnetized ferrite magnetic rings 20 and 21 divided into three sectors adjoin the sleeves 17 and 19 which rings bear against longitudinal ridges 26 (see FIG. 2). Said longitudinal ridges make it possible for cooling air to flow between the pole plates and the sintered magnets. The thermal contact between said parts is as small as possible which is desired in connection with the strongly temperature-dependent magnetization of the sintered magnets. Normally available models destined for small electric motors may be used for the magnet sectors 20 and 21. The magnet yoke is constituted by a box 24 which is open at the front and at the rear the upper and lower sides, respectively, of which adjoin the magnets with flanges 23 and 22. The cooling fins are denoted by 25. The dimensions of the magnetron appear from the scale shown in cm. With a magnetic field strength between the anode and the cathode of 1400 Gauss, an anode voltage of 4 kV (peak value of half-wave doubling circuit) and an anode-cathode current of 0.4 A, the power supplied at 2450 MHz is 1 kW.

Figure 2:
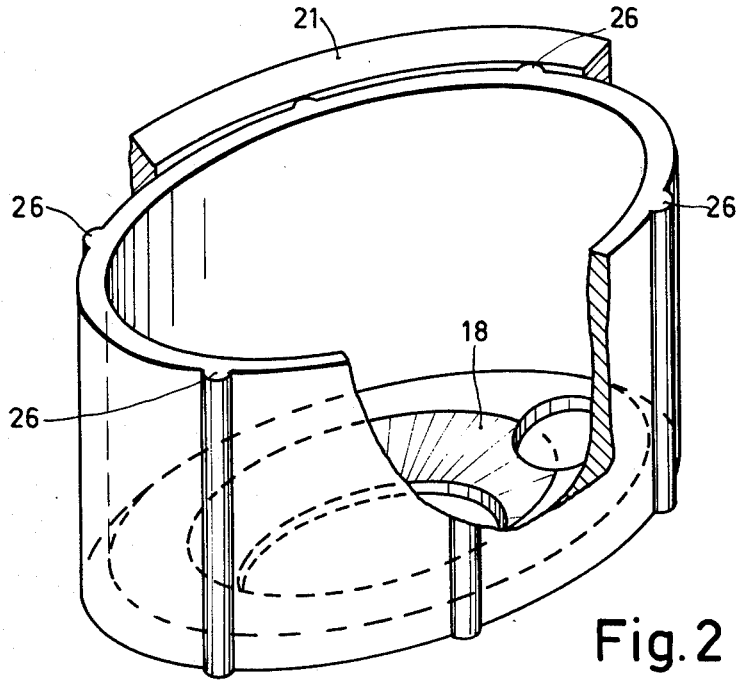
FIG. 2 shows a poleshoe-pole plate combination with a part of a magnet for the magnetron shown in FIG. 1.

The construction shown in FIG. 2 has been obtained by deep-drawing and punching.

Figure 3:
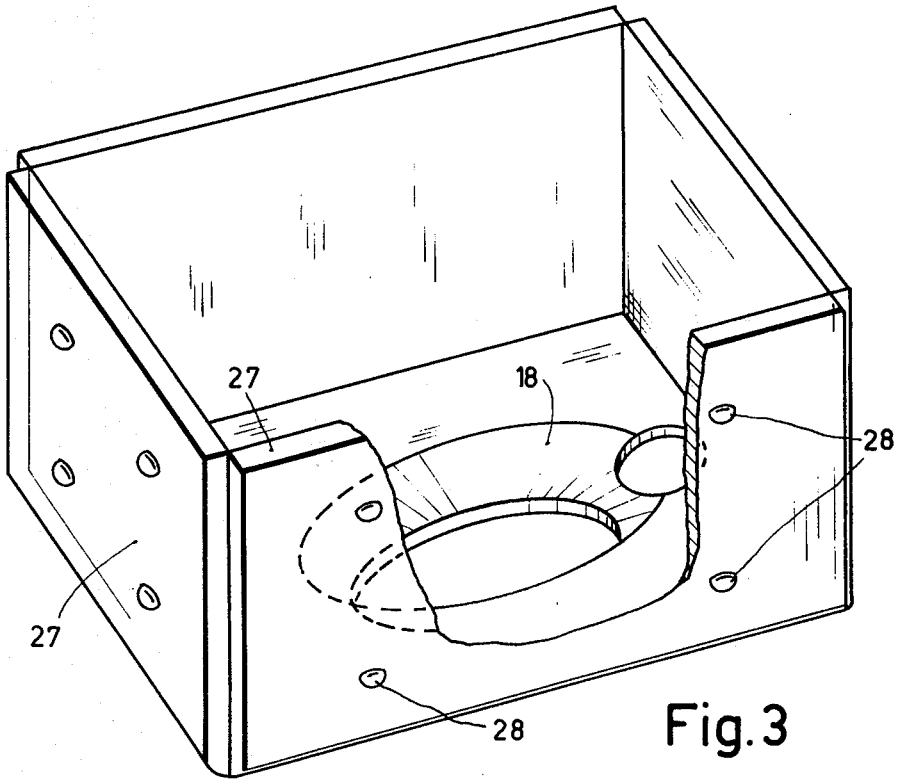
FIG. 3 shows a poleshoe-pole plate combination of a square construction.

FIG. 3 shows a variation of the poleshoe-pole plate shown in FIG. 2. The pole plates are rectangular parts 27 obtained by perpendicular folding relative to poleshoe 18. In this case rectangular blocks of magnetic material may be used. Spacing studs 28 to reduce the thermal contact are present on the pole plates 27.

In FIG. 4 the magnetic rings 20 and 21 are connected by a soft-steel cylinder 29. Between the anode housing 1 and said cylinder 29 is a tightly fitting aluminum ring 30 which has been provided between said parts by means of a sliding paste (fat-metal powder mixture). With the same dimensions as in FIG. 1 but with a discharge current of 0.25 A, the magnetron is suitable for a supplied power of 0.6 kW.

What is claimed is:

1. A resonant cavity magnetron comprising an anode housing defining a central axis and two opposite openings around said axis, cathode and anode members arranged within said housing, single-piece soft magnetic shells each including a poleshoe projecting through one opening into said housing, and a poleplate member extending parallel to said axis outside said housing, an intermediate portion between said poleshoe and said poleplate member being hermetically connected to said housing, radially magnetized permanent magnets surrounding respectively, said poleplate members, cathode filament connections extending along said axis through one poleplate member, and coupling-out lead extending through the other poleplate member, and a tubular partition arranged within each poleplate member, each partition being hermetically connected at one end thereof to said intermediate portion of the assigned soft magnetic part and at the other end thereof being closed by an insulating member for sealing said filament connection or coupling-out lead from the vacuum space within said anode housing and said poleplate members.

2. A resonant cavity magnetron as claimed in claim 1, wherein the magnets include rings divided into sectors a magnetic yoke consisting of a soft magnetic sleeve, a metal ring being clamped between the anode housing and said sleeve.

* * * * *